US005874028A

United States Patent [19]

Liang et al.

[11] Patent Number: 5,874,028

[45] Date of Patent: Feb. 23, 1999

[54] STRUCTURAL IMPROVEMENT ON A CARBURETOR FOR MOTORCYCLES

[76] Inventors: Shih-Chuan Liang, No. 27, Lane 112, An-Hsi St.; H. P. Liang, No. 13, Lane 112, An-Hsi St., both of An-Hsi Tsun, Hsiu-Shui Hsiang, Changhua Hsien, Taiwan

[21] Appl. No.: 907,921

[22] Filed: Aug. 11, 1997

[51] Int. Cl.[6] ..... F02M 29/04

[52] U.S. Cl. ..... 261/44.4; 261/78.1; 261/DIG. 55

[58] Field of Search ..... 261/44.4, 78.1, 261/44.3, DIG. 55; 123/437, 439, 590

[56] References Cited

U.S. PATENT DOCUMENTS

| | | | |
|---|---|---|---|
| 1,706,557 | 3/1929 | Baumgardner et al. | 261/DIG. 55 |
| 3,467,072 | 9/1969 | Toesca | 261/DIG. 55 |
| 3,544,290 | 12/1970 | Larson, Sr. et al. | 261/DIG. 55 |
| 3,867,487 | 2/1975 | Matsumoto | 261/DIG. 55 |
| 4,044,080 | 8/1977 | Matsumoto et al. | 261/DIG. 55 |
| 4,360,482 | 11/1982 | Asai | 261/44.4 |
| 4,372,276 | 2/1983 | Bernhardsson et al. | 261/44.4 X |
| 4,485,795 | 12/1984 | Lockard | 261/78.1 X |
| 4,517,134 | 5/1985 | Nakamura et al. | 123/439 X |
| 4,980,097 | 12/1990 | Edmonston | 261/44.3 |
| 5,300,259 | 4/1994 | Tashiro | 261/44.3 |
| 5,342,555 | 8/1994 | Edmonston | 261/78.1 X |
| 5,648,023 | 7/1997 | Nojima | 261/44.4 |

*Primary Examiner*—Richard L. Chiesa
*Attorney, Agent, or Firm*—Browdy and Neimark

[57] ABSTRACT

A structural improvement on a carburetor for motorcycles, and more particularly relating to a carburetor provided with an oil re-atomizing device intends to ensure an almost complete atomization of injected oil before delivery into a combustion chamber of an engine. Near the middle of a horizontally extended air passage of the carburetor is disposed a smoothly enlarged section having an increasingly expanded diameter so as to permit a re-atomizing device to be mounted to the end of the section. The re-atomizing device is made up of a cone-shaped head portion and a circular supporting bracket that are fixed together by a screw. Oil sucked into the air passage via a needle controlled oil supply passage is brought into direct collision against the round ended cone-shaped head portion of the re-atomizing device. The bottom of the head portion is provided with a flanged skirt which has a peripheral recess so that the mixture of air and oil will produce eddy current pressure at the flanged skirt, resulting in full and effective atomization of the mixture flow before it enters the combustion chamber of an engine.

2 Claims, 6 Drawing Sheets

STRUCTURAL IMPROVEMENT ON A CARBURETOR FOR MOTORCYCLES

BACKGROUND OF THE INVENTION

The present invention relates to a structural improvement on a carburetor for motorcycles and more particularly to a carburetor provided with an oil re-atomizing device so as to ensure an almost complete atomization of injected gasoline before delivery into a combustion chamber of an engine. Near the middle of a horizontally extended air passage of the carburetor is disposed a section having an increasingly expanded diameter so as to permit a re-atomizing device to be mounted to the end of the section. The re-atomizing device is made up of a cone-shaped head portion and a circular supporting bracket that are fixed together by a screw. Oil sucked into the air passage via a needle controlled oil supply passage is brought into direct collision against the cone-shaped head portion of the re-atomizing device. The bottom of the head portion is provided with a flanged skirt which has a peripheral recess so that the mixture of air and oil will produce eddy current pressure at the flanged skirt, resulting in full and effective atomization of the mixture flow before it enters the combustion chamber of an engine.

Referring to FIG. 1, a first conventional carburetor 10 has a horizontal air passage 11 and a vertical vacuum-operated valve member 12 having a needle 13 disposed at the bottom end of the piston member 12. The piston member 12 partially housed in the air passage 11 is disposed near the front portion of the carburetor. The needle 13 is movably inserted into an oil supply path 15 in communication with an oil reservoir 14 located at the bottom of the carburetor 10. At the rear portion of air passage 11 is placed a throttle valve 16. Air can be led into the air passage 11 from the front end thereof. The speedy flow of air into the air passage 11 results in the suction of gasoline from the oil reservoir 14 into the air passage 11 via the clearance between the needle 13 and the oil supply path 15. As shown in FIG. 2, the supplied gasoline or oil is delivered axially forward along with air in the air passage 11 in atomized particles.

Referring to FIGS. 3, 4, the second prior art carburetor 20 has a horizontal air passage 21 in which an adjustable Venturi-tube 22 including a round-ended cone member 221, a bell-shaped cover 222, a supporting bracket 223, a spring 224 and a central shaft 225 is housed. An oil reservoir 23 is located under the carburetor 20 and 4 nozzles 24 are used to inject oil to the adjustable Venturi-tube 22 from the reservoir 23. In operation, air is introduced into the air passage 21 from the front end thereof, and the injected oil from the 4 nozzles will be guided along the contour of the round-ended cone member 221 of the Venturi-tube 22 so as to make the oil atomized into particles, as shown in FIG. 5.

The above listed prior arts have the following disadvantages: the carburetors 10, 20 can not get the oil atomized effectively, resulting in incomplete combustion of the gasoline injected into combustion chambers of an engine and oil consumption is high in such carburetor-associated engines and air pollution as a result of producing massive amount of carbon monoxide is another serious problem.

SUMMARY OF THE INVENTION

Therefore, the primary object of the present invention is to provide a structural improvement on a carburetor for motorcycles which intends to get the gasoline particles in a carburetor atomized in a finer manner so as to permit the gasoline injected into a combustion chamber to completely burn out, making the gas consumption effectively dropped and the air pollution to environment reduced.

DETAILED DESCRIPTION OF THE PREFERRED EMBODIMENTS

Figure 6:
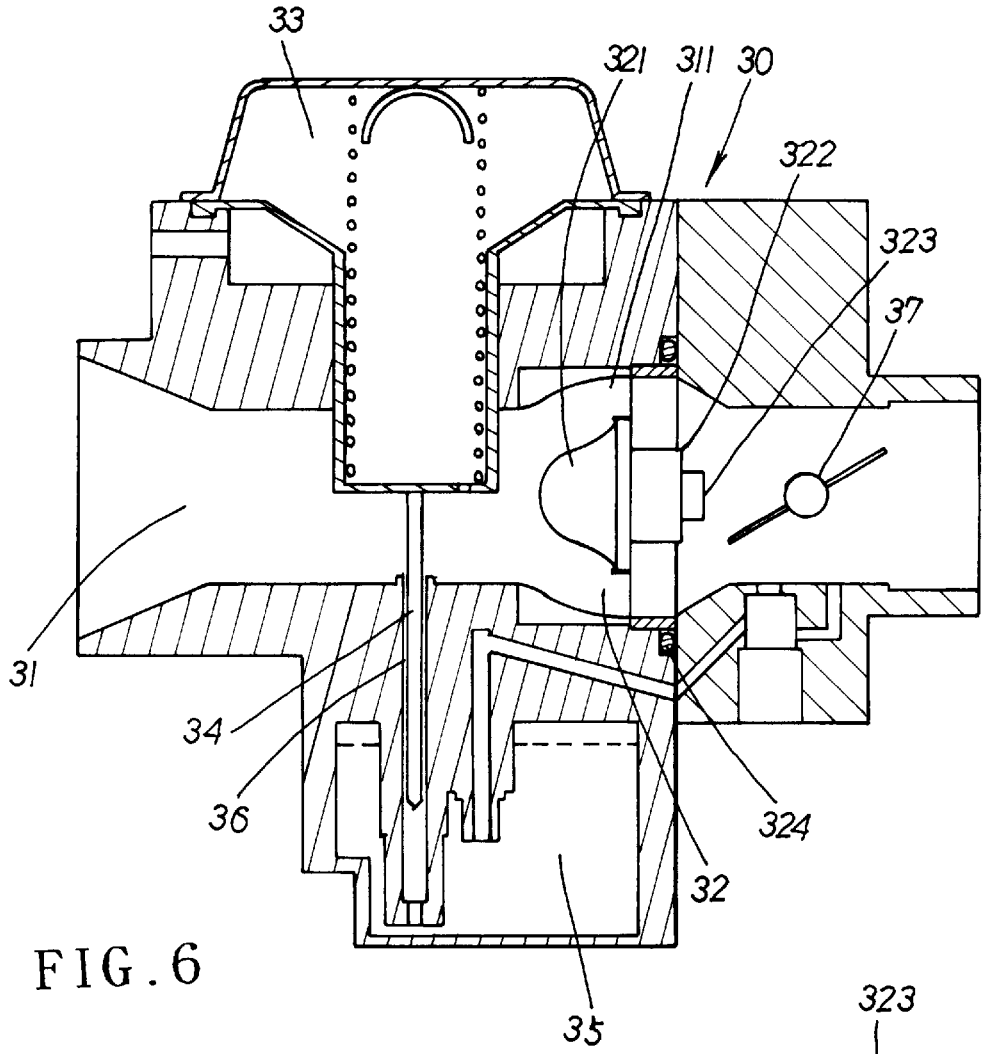
FIG. 6 is a sectional diagram of the improved carburetor of the present invention.
Figure 6A:
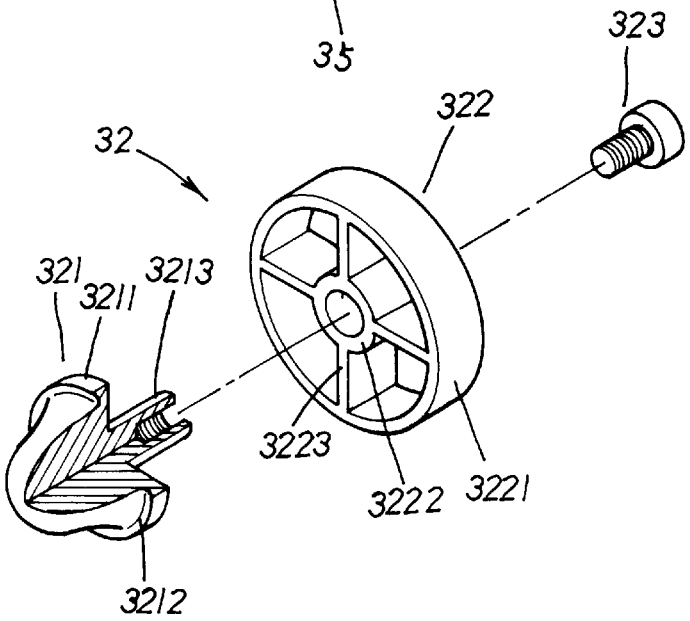
FIG. 6A is an enlarged diagram of the re-atomizing device of the present invention.
Figure 8:
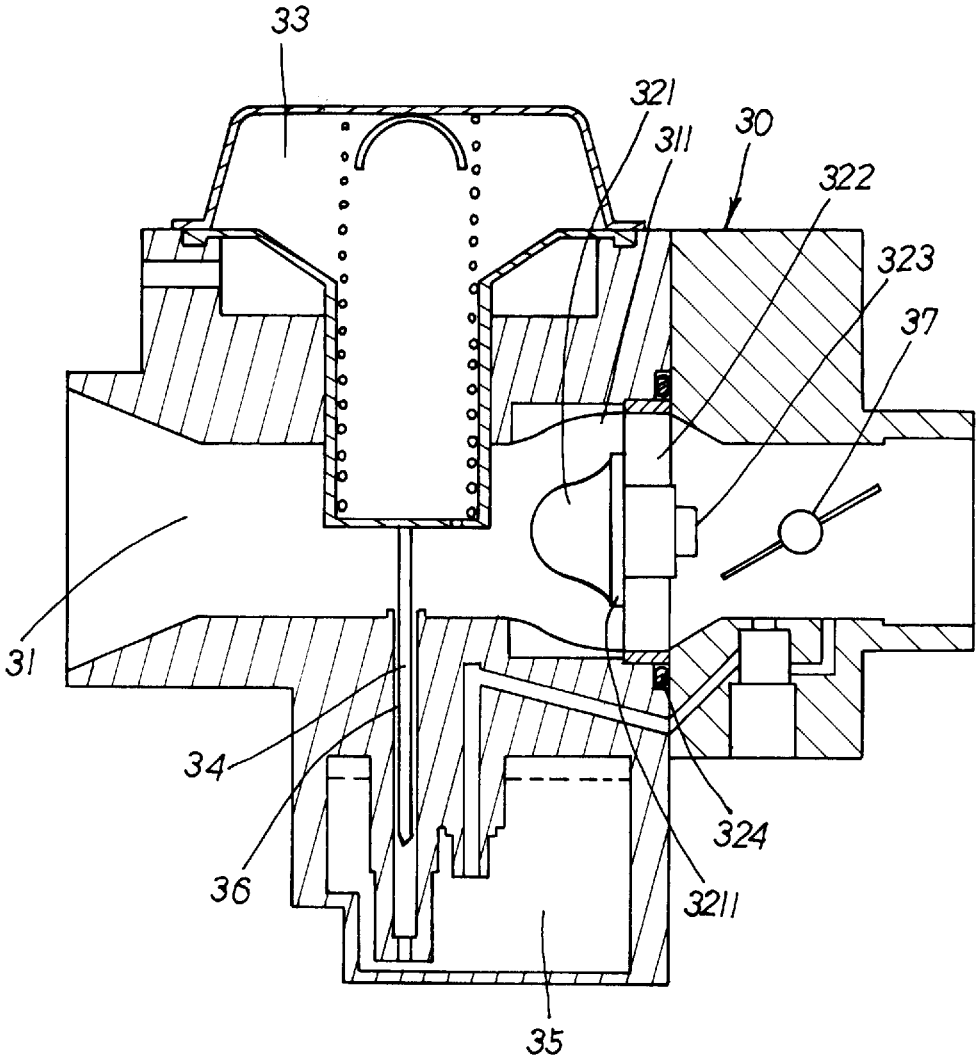
FIG. 8 is a diagram showing another embodiment of the present invention.

Referring to FIGS. 6, 6A, the carburetor 30 of the present invention is provided with a horizontal air passage 31 which has a smoothly enlarged rear portion 311. A re-atomizing device 32 is located at the enlarged rear portion 311. The re-atomizing device 32 is made up of a round-ended cone head 321, a supporting ring bracket 22 and a screw 323 having a hexagon-ended cavity.

The round-ended cone 321 has a bottom flange 3211 which is provided with a peripheral recess 3212 on the front side thereof, and an innerly threaded tubular rod 3213 extends centrally from the bottom end of the cone head 321. The supporting ring bracket 322 has two concentric rings 3221, 3222 supported in place by reinforcement ribs 3223 that are crossly located therebetween so as to permit the tubular rod 3213 of the cone head 321 to pass through the inner ring 3222 and to be fixedly mounted onto the supporting ring bracket 322 by the screw 323. The outer ring 3221 of the supporting ring bracket 322 is secured to the terminal of the enlarged rear portion 311 of the air passage 31 with a seal ring 324 attached to the outer periphery of the outer ring 3221.

Near the top of the carburetor 30 is disposed a vacuum operated piston valve 33 which partially extends in the air passage 31. A control needle 34 extending from the bottom end of the vacuum operated piston valve 33 is movably located in a vertical tubular oil supply path 36 of an oil supplying reservoir 35 disposed under the carburetor 30. A throttle valve 37 is located at the rear end of the air passage 31 for control of the inflow air volume.

Figure 1:
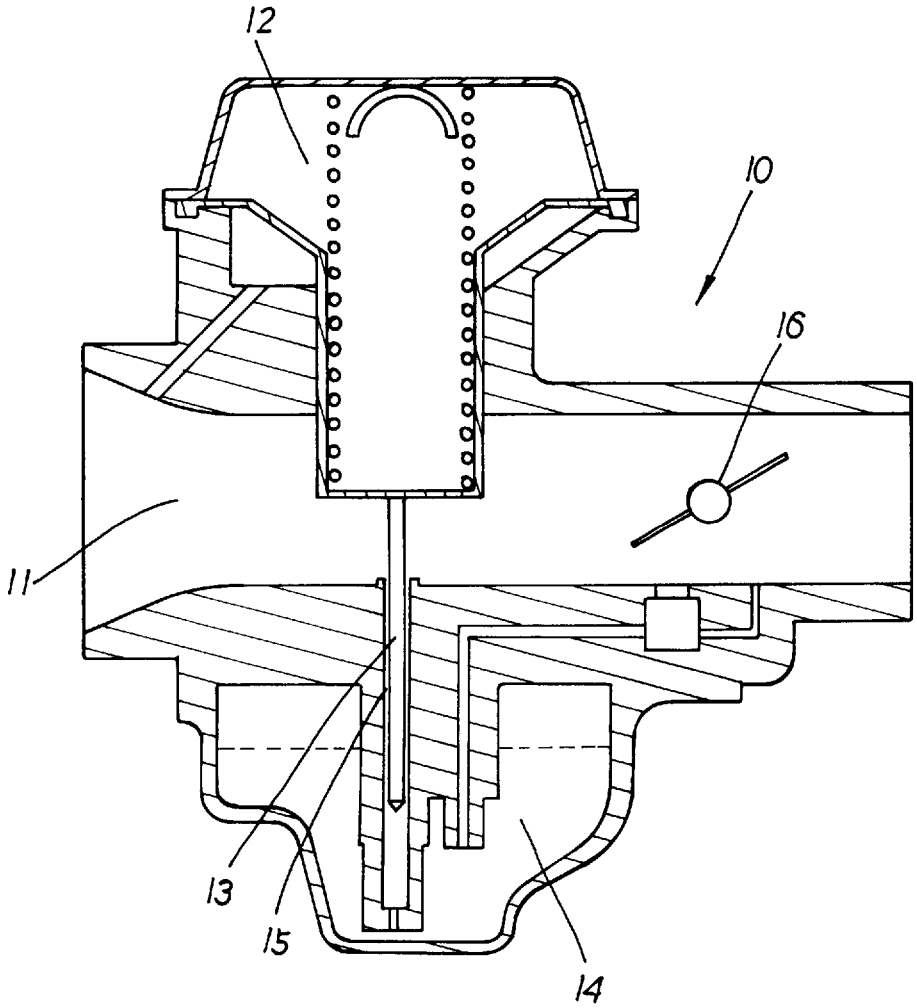
FIG. 1 PRIOR ART
FIG. 1 is a sectional diagram showing the structure of a first prior art carburetor.
Figure 2:
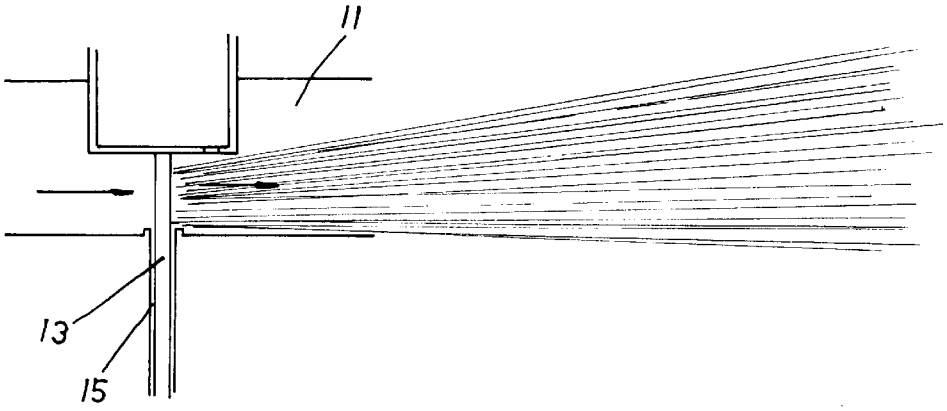
FIG. 2 PRIOR ART
FIG. 2 is a diagram showing the operation mode of the first prior art carburetor.
Figure 5:
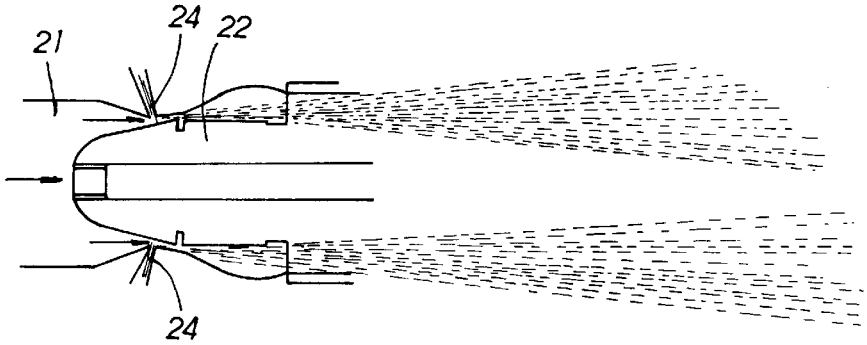
FIG. 5 PRIOR ART
FIG. 5 is a diagram showing the operation mode of the second prior art carburetor.
Figure 7:
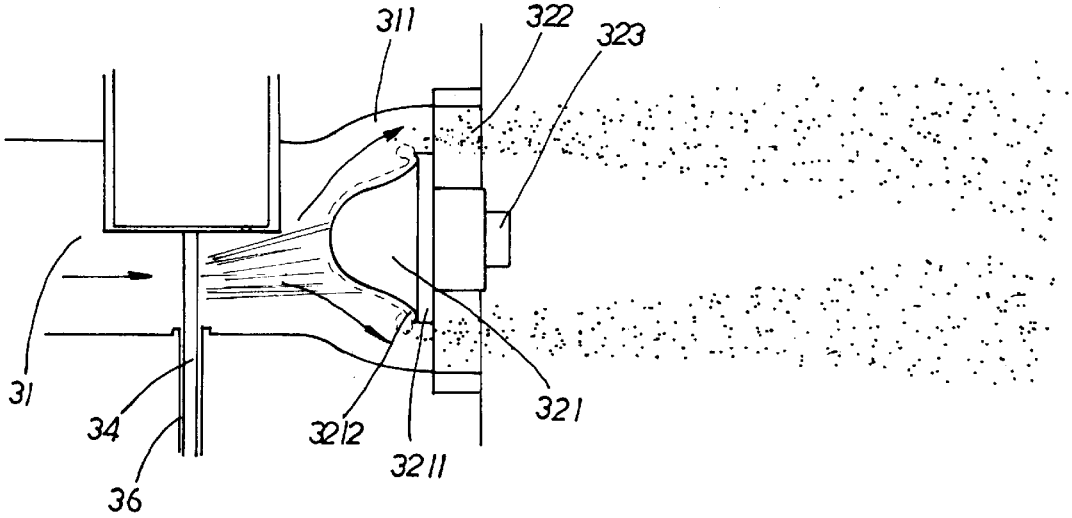
FIG. 7 is a diagram showing the operation mode of the present invention.
Figure 3:
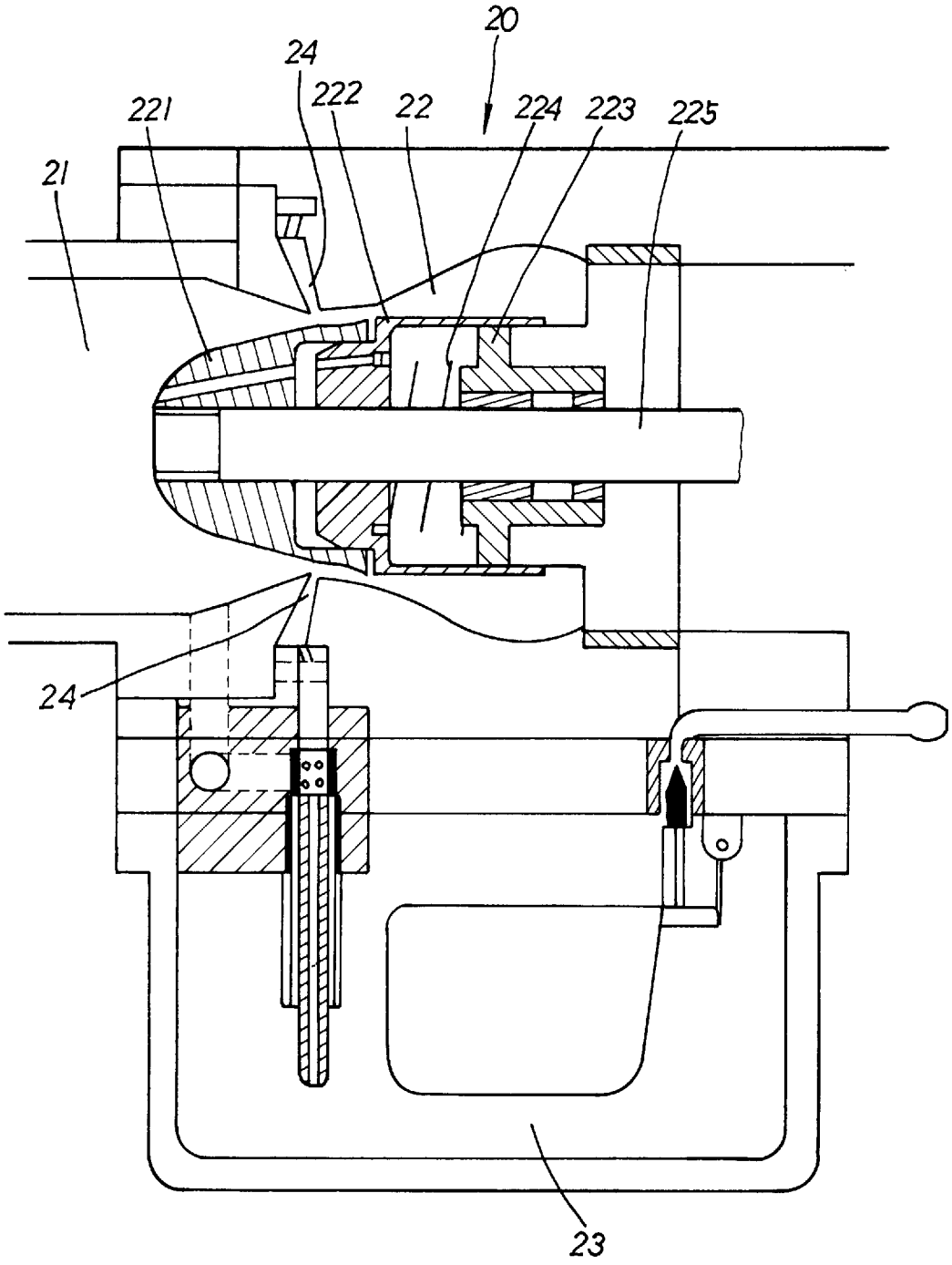
FIG. 3 PRIOR ART
FIG. 3 is a side view of a second prior art carburetor.
Figure 4:
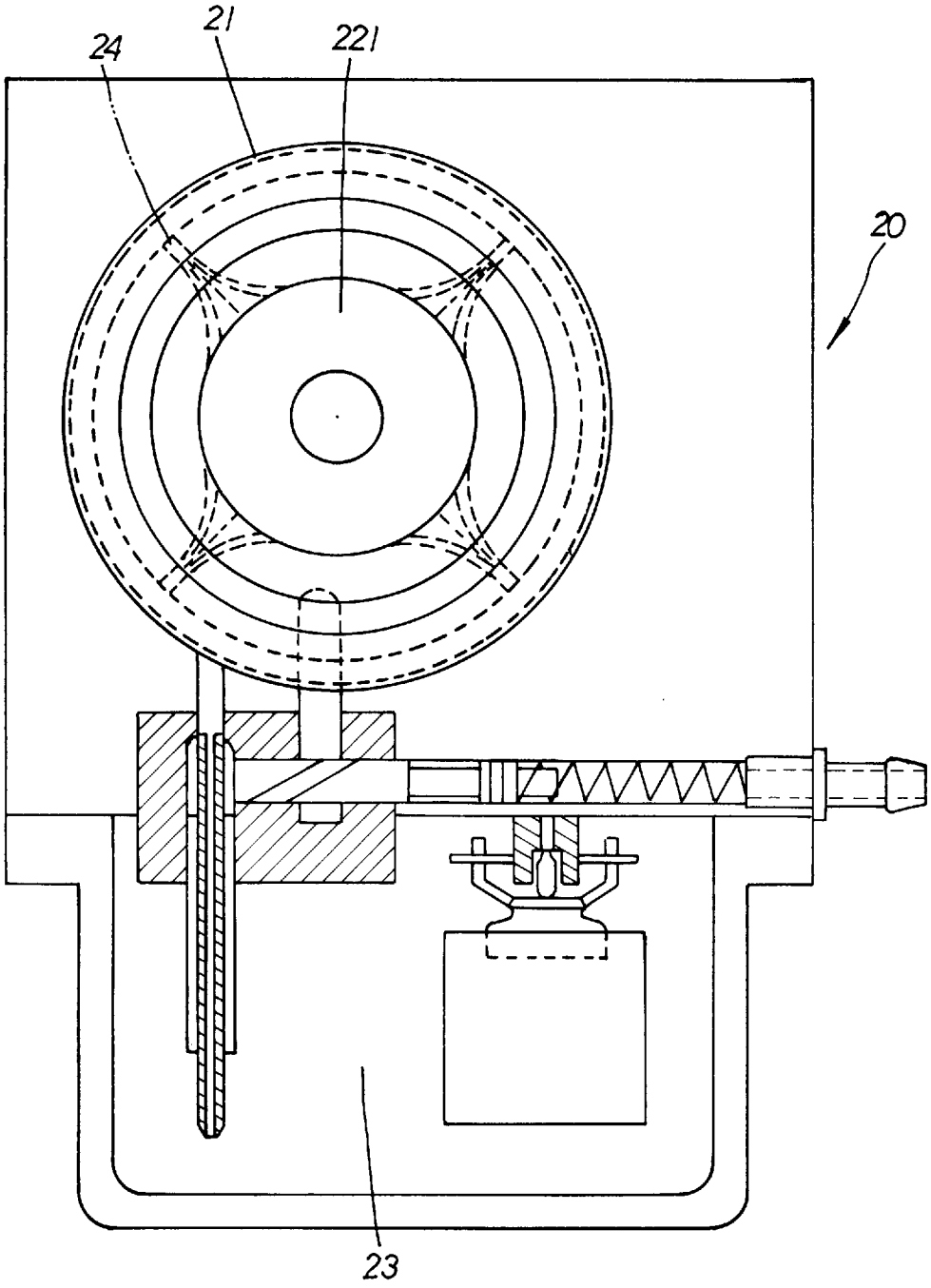
FIG. 4 PRIOR ART
FIG. 4 is a front side view of the second prior art carburetor.

In practical operation, air is introduced from the front end of the air passage 31 and the in-flushing air results in the sucking in of the oil supplied by the supplying reservoir 35 via the clearance between the control needle 34 and the vertical oil supply path 36. As shown in FIG. 7, the oil brought into the air passage 31 is delivered in thread-like form further forwardly with the air flow and collides against the round-ended cone head 321 of the re-atomizing device 32 into broken threads and further moves to bottom flange 3211 of the cone head 321, producing eddy current wave pressure at the peripheral recess 3212 of the bottom flange 3211. And the so processed oil particles are further delivered by air flow in the air passage 31 so as to make the same into finely or completely atomized particles.

Referring to FIG. 7, a second embodiment of the present invention is illustrated wherein the peripheral recess 3212 defined at the bottom flange 3211 of the round-ended cone head 321 of the re-atomizing device 32 is replaced by a right-angled peripheral edge.

It becomes apparent that the injected oil in the air passage 31 in the carburetor 30 can almost completely be atomized after bumps into the round-ended cone head 321 of the re-atomizing device 32 so as to make the combustion of the oil in an engine in a more complete manner, increasing the consumption efficiency and reducing air pollution of the waste discharge of the engine.

We claim:

1. A structural improvement on a carburetor for motorcycles, wherein said carburetor comprises a horizontal air passage having a smoothly enlarged section near the middle thereof; a vacuum piston valve is mounted to the top of said carburetor with a partial portion thereof extending into said air passage; a control needle connected to a bottom end of said valve is inserted into a vertical tubular oil supply path in communication with an oil reservoir disposed at the bottom of said carburetor; a throttle valve is disposed at the rear end of said air passage; the improvement is characterized by that a re-atomizing device is secured to said enlarged section near the middle of said air passage; said re-atomizing device is further comprised of:

a round ended cone head;

a supporting ring bracket;

a screw with a head having an inner hexagonal cavity; said cone head having a bottom flange equipped with a peripheral recess on a side pointing to the inlet of said air passage;

a tubular rod having inner threads extending from said cone head toward said rear end of said air passage;

said supporting ring bracket having two concentric rings, an inner ring and an outer ring that are supported in place by crossly defined reinforcement ribs fixed between said ring members;

said tubular rod being led through said inner ring of said supporting ring bracket so as to secure said round-ended cone head to said ring bracket by way of said screw;

whereby oil supplied from said oil supply reservoir via the clearance between said control needle and said tubular oil supply path is brought into said air passage along an air flow therein and said oil will first bump into said round ended cone head of said re-atomizing device and moves further against said peripheral recess of said bottom flange of said cone head so as to effectively atomize the oil in said air passage into fine particles for complete combustion in a combustion chamber of an engine.

2. The structural improvement on a carburetor as claimed in claim 1 wherein said bottom flange of said re-atomizing device is not provided with said peripheral recess but a right-angled edge on one side thereof.

* * * * *